US011780104B2

(12) United States Patent
Phoon

(10) Patent No.: US 11,780,104 B2
(45) Date of Patent: Oct. 10, 2023

(54) BLADE SET FOR A HAIR CUTTING APPLIANCE ARRANGED TO BE MOVED THROUGH HAIR IN A MOVING DIRECTION TO CUT HAIR

(71) Applicant: KONINKLIJKE PHILIPS N.V., Eindhoven (NL)

(72) Inventor: Kin Fatt Phoon, Drachten (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 402 days.

(21) Appl. No.: 16/652,706

(22) PCT Filed: Sep. 25, 2018

(86) PCT No.: PCT/EP2018/075863
§ 371 (c)(1),
(2) Date: Apr. 1, 2020

(87) PCT Pub. No.: WO2019/068500
PCT Pub. Date: Apr. 11, 2019

(65) Prior Publication Data

US 2020/0316794 A1 Oct. 8, 2020

(30) Foreign Application Priority Data

Oct. 5, 2017 (EP) ..... 17194858

(51) Int. Cl.
*B26B 19/38* (2006.01)
*B26B 19/06* (2006.01)

(52) U.S. Cl.
CPC ..... *B26B 19/3846* (2013.01); *B26B 19/06* (2013.01); *B26B 19/3893* (2013.01)

(58) Field of Classification Search
CPC ..... B26B 19/02; B26B 19/042; B26B 19/06; B26B 19/063; B26B 19/3846; B26B 19/3893; B26B 19/04; B26B 19/38
(Continued)

(56) References Cited

U.S. PATENT DOCUMENTS 2,102,529 A * 12/1937 Hanley ..... B26B 19/042 30/43.92
2,249,825 A 7/1941 Hanley
(Continued)

FOREIGN PATENT DOCUMENTS

CN 106346519 1/2017
WO 01/98040 12/2001
(Continued)

OTHER PUBLICATIONS

International Search Report and Written Opinion dated Dec. 21, 2018 for International Application No. PCT/EP2018/075863 Filed Sep. 25, 2018.
(Continued)

*Primary Examiner* — Jason Daniel Prone

(57) ABSTRACT

A blade set for a hair cutting appliance is described. The blade set (26) is arranged to be moved through hair in a moving direction to cut hair, and includes a stationary blade including a support insert and a metal component. The metal component and the support insert are force-fitted to one another. The metal component is at least sectionally deformed to define at least one toothed leading edge having double-walled stationary blade teeth. The metal component forms a first wall that is arranged to serve as a skin-facing wall when in operation, and a second wall that is facing away from the first wall. A guide slot for a movable blade is defined between inwardly facing inner surfaces of the metal
(Continued)

component and the support insert and a movable blade having a plurality of movable blade teeth.

7 Claims, 8 Drawing Sheets

(58) Field of Classification Search
USPC ..... 30/43.7–43.92
See application file for complete search history.

(56) References Cited

U.S. PATENT DOCUMENTS

| | | | | |
|---|---|---|---|---|
| 2,273,739 | A | 2/1942 | Pas | |
| 5,341,571 | A | 8/1994 | Prochaska | |
| 5,893,211 | A * | 4/1999 | Hotani | B26B 19/06 30/43.92 |
| 5,909,929 | A * | 6/1999 | Chen | B26B 19/042 30/43.92 |
| 9,381,656 | B2 * | 7/2016 | Van Straaten | B26B 19/38 |
| 9,789,617 | B2 * | 10/2017 | Stapelbroek | B26B 19/06 |
| 10,682,777 | B2 * | 6/2020 | Huisman | B26B 19/3846 |
| 10,800,054 | B2 * | 10/2020 | Stapelbroek | B26B 19/06 |
| 10,857,686 | B2 * | 12/2020 | Wu | B26B 19/063 |
| 11,104,016 | B2 * | 8/2021 | Musallam | B26B 19/042 |
| 11,179,861 | B2 * | 11/2021 | Khubani | B26B 19/3846 |
| 11,318,629 | B2 * | 5/2022 | Godlieb | B26B 19/3846 |
| 11,370,134 | B2 * | 6/2022 | Phoon | B26B 19/06 |
| 11,453,137 | B2 * | 9/2022 | Godlieb | B26B 19/06 |
| 11,465,303 | B2 * | 10/2022 | Stapelbroek | B26B 19/06 |
| 2015/0047203 | A1 | 2/2015 | Stapelbroek | |
| 2016/0236363 | A1 * | 8/2016 | Stapelbroek | B26B 19/06 |
| 2016/0271814 | A1 * | 9/2016 | Bennik | B26B 19/3846 |
| 2017/0028574 | A1 * | 2/2017 | Iaccarino | B26B 19/20 |
| 2017/0028576 | A1 | 2/2017 | Sablatschan | |
| 2017/0113361 | A1 * | 4/2017 | Feijen | B26B 19/3893 |
| 2017/0144319 | A1 * | 5/2017 | Sablatschan | B26B 19/3893 |
| 2018/0257248 | A1 * | 9/2018 | Wu | B26B 19/3846 |
| 2020/0164533 | A1 * | 5/2020 | Phoon | B26B 19/3846 |
| 2021/0229304 | A1 * | 7/2021 | Koeppl | B26B 19/3846 |
| 2021/0260783 | A1 * | 8/2021 | Koeppl | B26B 19/3846 |
| 2021/0339412 | A1 * | 11/2021 | Van Veldhuizen | B26B 19/3853 |
| 2021/0347069 | A1 * | 11/2021 | Röder | B26B 19/063 |
| 2021/0347070 | A1 * | 11/2021 | Röder | B26B 19/3846 |
| 2021/0347071 | A1 * | 11/2021 | Xu | B26B 19/3846 |
| 2021/0347072 | A1 * | 11/2021 | Xu | B26B 19/3846 |
| 2021/0347076 | A1 * | 11/2021 | Xu | B26B 19/3846 |

FOREIGN PATENT DOCUMENTS

| | | | |
|---|---|---|---|
| WO | 2013/150412 | 10/2013 | |
| WO | 2015/158923 | 10/2015 | |
| WO | 2016/001019 | 1/2016 | |
| WO | 2016/042158 | 3/2016 | |
| WO | 2016/173846 | 11/2016 | |
| WO | WO-2018068353 A1 * | 4/2018 | B26B 19/042 |
| WO | 2018/219704 | 12/2018 | |

OTHER PUBLICATIONS

Written Opinion of the International Preliminary Examining Authority dated Sep. 11, 2019 for International Application No. PCT/EP2018/075863 Filed Sep. 25, 2018.

International Preliminary Report on Patentability dated Jan. 24, 2020 for International Application No. PCT/EP2018/075863 Filed Sep. 25, 2018.

* cited by examiner

BLADE SET FOR A HAIR CUTTING APPLIANCE ARRANGED TO BE MOVED THROUGH HAIR IN A MOVING DIRECTION TO CUT HAIR

CROSS REFERENCE TO RELATED APPLICATIONS

This application is the U.S. National Phase application under 35 U.S.C. § 371 of International Application No. PCT/EP2018/075863 filed Sep. 25, 2018, published as WO 2019/068500 on Apr. 11, 2019, which claims the benefit of European Patent Application Number 17194858.1 filed Oct. 5, 2017. These applications are hereby incorporated by reference herein.

FIELD OF THE INVENTION

The present disclosure relates to a blade set of a hair cutting appliance and to a respectively equipped hair cutting appliance. Further, the present disclosure relates to a method of manufacturing a blade set for a hair cutting appliance.

BACKGROUND OF THE INVENTION

WO 2013/150412 A1 discloses a stationary blade for a blade set of an electrically operated hair cutting appliance, the blade including a first wall and a second wall, each wall defining a first surface, a second surface facing away from the first surface, and a laterally extending leading edge defining a plurality of laterally spaced apart longitudinally extending projections, wherein the first surfaces of the first and second walls face each other, at least at their leading edges, while facing projections along the leading edges of the first and second walls are mutually connected at their tips to define a plurality of generally U-shaped teeth, and the first surfaces of the first and second walls define a laterally extending guide slot for a movable blade of said blade set between them, wherein the projections of the first wall have an average thickness that is less than an average thickness of the projections of the second wall.

Manufacturing approaches to double walled stationary blades are disclosed in WO 2016/001019 A1 and WO 2016/042158 A1 that describe arrangements wherein at least the top wall of the stationary blade is at least substantially made from sheet metal material. In both documents, an integral design of metal parts and non-metal parts is proposed, involving integrally manufacturing sheet metal and injection molding parts. Hence, insert molding and/or overmolding are proposed to combine the benefits of metal components and non-metal molded components.

CN 106346519 A discloses a blade set for a cutter head of a shaver, the blade set comprising a fixed blade that is provided with a toothed leading edge, a fixed blade bracket for supporting and securing the fixed blade, and, at an inner side of the fixed blade, a moving blade having corresponding teeth, wherein the moving blade can move back and forth relative to the fixed blade to cut hair, and wherein the fixed blade is a flexible metal sheet that is tensioned and secured at the fixed blade bracket. CN 106346519 A further proposes to tension the flexible metal sheet by the fixed blade bracket similar to a bowstring. To this end, it is further proposed to fold the flexible metal sheet around front and rear edges of the fixed blade bracket, and to secure the folded flexible metal sheet at the fixed blade bracket by any of welding, riveting and bonding.

Cutting appliances are well known in the art. Cutting appliances may particularly involve hair cutting appliances. In a more general context, the present disclosure addresses personal care appliances, particularly grooming appliances. Grooming appliances involve, but are not limited to, hair cutting appliances, particularly trimming appliances, shaving appliances, and combined (dual-purpose or multi-purpose) appliances.

Hair cutting appliances are used for cutting human hair, and occasionally animal hair. Hair cutting appliances may be used for cutting facial hair, particularly for shaving and/or for beard trimming. Further, cutting appliances are used for cutting (involving shaving and trimming) head hair and body hair.

In the trimming mode, the hair cutting appliance is typically equipped with a so-called spacing comb that is arranged to space away the blade set of the hair cutting appliance from the skin. Depending on the effective (offset) length of the spacing comb, a remaining hair length after the trimming operation may be defined.

Hair cutting appliances in the context of the present disclosure typically comprise a cutting head which may be referred to as processing head. At the cutting head, a blade set is provided, the blade set comprising a so-called stationary blade and a so-called movable blade. When the hair cutting appliance is operated, the movable blade is moved with respect to the stationary blade which may involve that respective cutting edges cooperate with one another to cut hair.

Hence, in the context of the present disclosure a stationary blade is arranged to be attached to the hair cutting appliance in such a way that a drive unit thereof is not cooperating with the stationary blade. Rather, the drive unit is typically coupled with the movable blade and arranged to set the movable blade into motion with respect to the stationary blade. Hence, the stationary blade may be, in some embodiments, fixedly attached to a housing of the hair cutting appliance.

However, in alternative embodiments, the stationary blade is arranged at the housing of the hair cutting appliance in a pivotable fashion. This may for instance enable a contour-following feature of the cutting head of the hair cutting appliance. Therefore, the term stationary blade, as used herein, shall not be interpreted in a limiting sense. Further, needless to say, when the hair cutting appliance as such is moved, also the stationary blade is moved. However, the stationary blade is not arranged to be actively actuated to cause a cutting action. Rather, the movable blade is arranged to be moved with respect to the stationary blade.

The stationary blade may also be referred to as guard blade. Typically, when the hair cutting appliance is operated to cut hair, the stationary blade is, at least in part, arranged between the movable blade and the hair or skin of the user. As used herein, the term user shall refer to a person or subject whose hair is being processed or cut. In other words, the user and the operator of the hair cutting appliance are not necessarily one and the same person. The term user may also involve a client at a hairdresser or barber shop.

In some aspects, the present disclosure relates to hair cutting appliances that are capable of both trimming and shaving operations. In this context, hair cutting appliances are known that incorporate a dual cutting arrangement including a first blade set that is suitably configured for trimming and a second blade set that is suitably configured for shaving. For instance, the shaving blade set may include a perforated foil that cooperates with a movable cutting element. Rather, the trimming blade set may include two blades that are respectively provided with teeth that cooperate with one another. In principle, the perforated foil that forms the stationary part of the shaving blade set may be much thinner than the stationary blade of a trimming blade set which, primarily for strength reasons, must be considerably thicker in conventional appliances.

The above WO 2013/150412 A1 proposes to provide the stationary blade with two walls, one of which is facing the skin of the user and the other one facing away from the user. The two walls are connected to one another and define, in a lateral view, a U-shaped profile that forms a guide slot for a movable cutter blade. Hence, the stationary blade is a double-walled blade. This has the advantage that the first wall may be arranged in a considerably thinner fashion as the second wall provides the stationary blade with sufficient strength. Therefore, such an arrangement is suitable for trimming, as respective teeth may be provided at the stationary blade and the movable blade. Further, the blade set is suitable for shaving as the effective thickness of the first wall of the stationary blade is considerably reduced.

Hence, several approaches to the manufacture of double-walled stationary blades and respective blade sets have been proposed. However, at least some of the above-indicated approaches still involve relatively high manufacturing costs, particularly molding costs and tooling costs. In particular, a combined sheet metal and injection molding approach, that involves insert molding or overmolding techniques, requires specific tools and manufacturing facilities. Further, relatively complex and cost-increasing auxiliary processes may be required, for instance grinding, lapping, deburring, etc.

Hence, in this respect, there is still room for improvement in the manufacture of blade sets for hair cutting appliances.

SUMMARY OF THE INVENTION

In view of the above, it is an object of the present disclosure to provide a blade set for a hair cutting appliance, and a corresponding method of manufacturing a blade set that enable a cost-efficient manufacture while maintaining the benefits of the double-walled design as discussed above. More particularly, it would be beneficial to present a method of manufacturing a blade set that primarily relies on rather simple manufacturing approaches that preferably do not require expensive tooling and complicated post-processing and/or assembly procedures. Further, it would be beneficial to dispense with hybrid manufacturing approaches that combine two or more rather distinct and different manufacturing methods (such as insert molding and/or overmolding of sheet metal components).

In other words, it would be beneficial to present a manufacturing approach that is based on conventional manufacturing methods but that enables the manufacture of stationary blades and blade sets in accordance with the above-indicated novel design approaches.

It is a further object of the present disclosure to provide a hair cutting appliance to which a respective blade set may be mounted.

In a first aspect of the present disclosure there is presented a blade set for a hair cutting appliance, said blade set being arranged to be moved through hair in a moving direction to cut hair, said blade set comprising:

a stationary blade comprising a support insert and a metal component, wherein the metal component and the support insert are force-fitted to one another, wherein the metal component is at least sectionally deformed to define at least one toothed leading edge having double-walled stationary blades teeth, wherein the metal component forms a first wall that is arranged to serve as a skin-facing wall when in operation, and a second wall that is facing away from the first wall, and wherein a guide slot for a movable blade is defined between inwardly facing inner surfaces of the metal component and a support insert, a movable blade comprising a plurality of movable blade teeth, wherein the movable blade is movably arranged between the metal component and the support insert in the guide slot, and wherein the movable blade is, in the mounted state, preloaded and movably arranged in the guide slot between the metal component and the support insert.

In accordance with the present disclosure, the final dimension (vertical extension or height) of the guide slot is only achieved when the movable blade is arranged therein. In other words, in an intermediate assembly state when the movable blade is not yet inserted, the guide slot may be "thinner" having a smaller height than in the final state. This is mainly induced by a preliminary deformation (bending procedure) of the metal component. Through this bending procedure, the first wall and at least one second wall section are formed at the metal component, wherein the first wall and the second wall define an offset there between, for instance an angular offset and/or a basically parallel offset.

The offset between the first wall and the second wall of the metal component may also be referred to as mounting clearance. The mounting clearance is deliberately formed to be at least slightly smaller than a resulting spacing offset between the first wall and the second wall of the metal component in the finally assembled state. Hence, in the intermediate assembly state, the shape of the second wall portions of the metal component may urge the first wall thereof to a relative position/orientation with respect to the support insert that does not correspond to the intended position in the finally assembled state. In other words, the first wall of the metal component is closer to the opposite support insert than in the finally assembled state of the blade set. This measure has the effect that upon inserting the movable blade in the guide slot, the metal component is at least slightly biased and deformed in an opposite direction so that eventually the first wall thereof assumes a final position and orientation with respect to the support insert.

In other words, in the finally assembled state, the first wall of the metal component is spaced away from the support insert by the movable blade. There is no direct connection between the first wall of the metal component and the support insert.

In accordance with the above presented aspect, the metal component and the support insert are force-fitted to one another. However, this does not exclude additional measures, for instance positive-fit connecting features such as snap-lock features, etc.

As used herein, the first wall of the metal component and the opposite support insert are spaced away from one another in the vertical direction to define the guide slot there between.

The above aspect is further based on the insight that the stationary blade may be manufactured using relatively simple and well-established manufacturing techniques, such as sheet metal processing, injection molding, etc. Preferably, the stationary blade is an assembled component of the blade set which may dispense with the need of complicated manufacturing techniques, such as 2K-injection molding, insert molding, overmolding and/or complex bonding techniques, involving welding, soldering, gluing, etc.

Hence, in contrast to the teaching of CN 106346519 A, it is not necessary to apply additional bonding techniques involving gluing, welding, riveting, soldering, etc., as the movable blade may apply a pretensioning force on the metal component that sufficiently secures the mounting position. The metal component and the support insert form a joint subassembly that is not yet in the final assembly state. Further, to form the first wall and the second, the metal component is transformed already before the insertion process takes place that results in the joint assembly comprising the support insert and the at least slightly pretensioned metal component.

Preferably, the support insert and the metal component that form at least a fundamental portion of the stationary blade each are easy to manufacture and, to form the stationary blade, easy to assemble. Further, the guide slot in which the movable blade is accommodated in the assembled state of the blade set is accomplished by assembling the support insert and the metal component, and by inserting the movable blade.

Generally, the first wall and the second wall may be parallel to one another, and/or inclined with respect to one another. Further, also at least partially curved shapes at least one of the first wall and the second wall may be envisaged. All these alternatives may form a double-walled arrangement having a first wall and a second wall that are facing away from one another.

In some embodiments, the metal component is based on a sheet metal blank that is deformed to form a U-shaped or a V-shaped arrangement at the respective toothed leading edges. This may involve bending or folding respective sections of the originally flat sheet metal component. In other words, at least in some embodiments, sections of the original sheet metal blank are wrapped around the support insert, thereby forming the first wall, the second wall, and the leading edge at the transition there between.

Generally, the stationary blade may also be referred to as guard blade. Generally, the movable blade may also be referred to as cutter blade.

As indicated above, approaches to deform the metal component may involve bending, folding, etc. Respective material processing methods are generally subject to certain tolerances. In other words, bending, folding and similar processing methods for sheet metal parts often do not result in high-precision parts, but involve certain relatively large tolerances.

However, by providing the movable blade that may be produced using a manufacturing method that enables high precision and great accuracy, a gage for the metal component may be provided. As the metal component is preferably shaped such that in the assembled state a certain preloading is present, primarily the shape (thickness) of the movable blade defines the resulting shape of the stationary blade, particularly in portions thereof that are important for the cutting performance.

The top side of the guide slot that is facing the skin when the blade set is in operation is delimited by the first wall of the stationary blade. In other words, the movable blade cooperates with the first wall, particularly with the portions of the stationary blade teeth that are formed at the first wall, to cut hair.

The movable blade provides a vertical connection between the first wall and the second wall. Generally, the vertical direction is perpendicular to a main extension plane of the first wall. Hence, the movable blade may define a height of the guide slot at the stationary blade. The vertical extension (height) of the guide slot is primarily defined by the shape of the movable blade which may be produced with relatively small tolerances. This has a beneficial effect on the overall accuracy and performance of the blade set that incorporates the stationary blade.

The support insert may be obtained from a molding process, particularly from injection molding. However, in some alternative embodiments, the support insert may be obtained from a casting process that processes metal material. Further, the support insert may be obtained by machining an intermediate part to form the desired final shape.

However, in major embodiments of the present disclosure, the support insert is a plastic part that is obtained from a relatively simple injection molding procedure. Preferably, complex combined manufacturing procedures such as insert molding, overmolding, multi-component molding, etc. may be avoided.

Generally, the support insert may be produced from plastic material, metal material, involving light metal, such as aluminum alloy, or from another appropriate material that is considerably solid and dimensionally stable.

The metal component and the movable blade may be obtained from sheet-metal machining.

Generally, in a state prior to the insertion of the movable blade, the vertical guide clearance between the first wall of the metal component and the support insert is smaller than in the assembly state subsequent to the insertion of the movable blade.

It is to be noted that it is preferred that the movable blade is only slightly preloaded between the first wall of the metal component and the support insert. This has a positive effect on ease of movement so that the required power for operating the blade set can be reduced.

In an exemplary embodiment of the blade set, the metal component is held in place by the support insert, wherein the inner surfaces of the metal component and the support insert are spaced from one another. As indicated before, the metal component and the support insert are force-fitted to one another due to the shape of (longitudinal ends of) the support insert and a defined offset between the first wall and the second wall portions of the metal component. Further, locking features enabling a positive-fit connection between the support insert and the metal component may be present. Overall, it is not absolutely necessary to apply further securing procedures, such as bonding, welding, gluing, etc.

In yet another exemplary embodiment of the blade set, the stationary blade teeth are, when viewed in a cross-sectional plane perpendicular to a lateral direction, substantially U-shaped or V-shaped, and comprise a first leg formed by the first wall and a second leg formed by the second wall, and wherein the first leg and the second leg merge into one another to form a tip of the stationary blade teeth. Hence, the deformation/bending procedure applied to the metal component on the one hand contributes to the force-fitted assembly of the metal component and the support insert end, on the other hand, defines the double-walled shape of the stationary blade teeth that covers the movable blade teeth in the assembled state.

In this context, in another exemplary embodiment of the blade set, a first leading edge and a second leading edge opposite to the first leading edge is formed at the stationary blade. In the assembled state, the first wall of the metal component extends from the first toothed leading edge to the second toothed leading edge. The movable blade comprises a first series of teeth and a second series of teeth that cooperate with the first leading edge and the second leading edge, respectively. As a result, the blade set is two-way operable.

In accordance with this embodiment, there are two portions respectively forming the second wall. A first portion is assigned to the first leading edge. A second portion is assigned to the second leading edge.

In yet another exemplary embodiment of the blade set, the first wall and the second wall of the stationary blade are spaced away from one another by the support insert and the movable blade. In the finally assembled state, in the region of the respective teeth of the stationary blade and the movable blade, a layered stack is formed. The layered stack involves the first wall at the skin-facing side, and the second wall at the opposite side. Between the first wall and the second wall, the movable blade and the support insert are arranged. The support insert is arranged between the second wall and the movable blade. The movable blade is arranged between the support insert and the first wall.

The metal component and the support insert form an interference-fitted assembly. Hence, a certain preloading may be present between the first wall and the opposite second wall portion so that a reliable connection between the metal component and the support insert is ensured.

In yet another exemplary embodiment of the blade set, the first wall and the second wall of the metal component are, in an unassembled state, spaced away from one another in a contact region by a clearance that is smaller than a vertical spacing offset defined by the support insert and the movable blade. As explained above, the clearance may involve a parallel offset and/or an angular offset between the first wall and the second wall.

In yet another exemplary embodiment of the blade set, the metal component is a sheet metal component. The support insert may be arranged as a separately formed injection molded plastic part. Hence, relatively simple and cost-efficient manufacturing procedures may be used to form the components of the blade set. Cutting edges of the teeth of the blade set are arranged at the metal component. The support insert strengthens the assembly and defines a closed profile together with the metal component, wherein the closed profile surrounds the guide slot for the movable blade.

In yet another exemplary embodiment of the blade set, a lateral guide for the movable blade is provided by a driving connector attached thereto, and wherein the driving connector is slidably received in a connector slot formed in the support insert. Typically, the driving connector is engaged by or forms part of a drive train of the hair cutting appliance. The driving connector extends through the support insert and transmits the driving movement to the movable blade. As used herein, the lateral guide is a basically laterally extending guide that is arranged in the laterally extending connector slot. The lateral guide provides for a longitudinal position of the movable blade with respect to the stationary blade. As a result, a tip to tip offset between the teeth of the movable blade and the stationary blade may be accurately defined.

Apart from the laterally extending connector slot for the driving connector, no further guiding features are necessary at the stationary blade to ensure the desired longitudinal position of the movable blade with respect to the stationary blade.

In still another exemplary embodiment of the blade set, the movable blade is secured in the guide slot by at least one lateral end cap that blocks a lateral end of the guide slot. Hence, the movable blade that is laterally movable in the guide slot is arranged within well-defined limits.

It is to be noted that in the alternative, a lateral movement of the movable blade may also be limited by the design of the driving connector and of the connector slot for the driving connector that is formed in the support insert. Hence, it is possible to form the blade set without respective lateral end caps. However, the at least one lateral end cap may also provide a further securing feature for the assembly of the metal component and the support insert.

In yet another exemplary embodiment of the blade set, a first lateral cap is formed at the support insert, and a second lateral cap is a separately formed part that is attached to the support insert opposite to the first lateral cap.

In another aspect of the present disclosure there is presented a method of manufacturing a blade set for a hair cutting appliance, the method comprising:

providing a metal component, comprising:

forming at least one pattern of slots in the metal component, transforming the metal component, thereby forming a first wall and a second wall, wherein the at least one pattern of slots defines a series of stationary blade teeth arranged at a toothed leading edge that is jointly formed by the first wall and the second wall, providing a support insert having a mounting extension that is greater than a mounting clearance between the first wall and the second wall, in a contact region between the support insert and the metal component, joining the metal component and the support insert, involving laterally inserting the support insert in the metal component, thereby forming a stationary blade, providing a movable blade having movable blade teeth, laterally inserting the movable blade in a guide slot formed at the stationary blade, and arranging the movable blade at the support insert, wherein, in a mounted state, the metal component is held in place by the support insert in the contact region, and wherein the movable blade is, in the mounted state, vertically preloaded and movably arranged in the guide slot between the metal component and the support insert.

Hence, an accurate fit and a close contact between the bottom side of the first wall and a top side of the movable blade may be ensured.

In an exemplary embodiment of the method, the step of joining the metal component and the support insert involves a force-fitted joining of the metal component and the support insert. This is achieved as the metal component is formed to be slightly smaller than in the finally assembled state when the support insert is inserted therein. In other words, in the finally assembled state, the support insert and the movable cutter blade at least slightly urge the first wall and the second wall of the metal component away from one another to generate a retaining force.

It is to be noted in this context that the above steps do not necessarily define a fixed mounting sequence, particularly in regard of the mounting of the support insert and the movable blade. In certain embodiments, initially the support insert is inserted in the metal component and then the movable blade is inserted in the guide slot formed between the metal component and the support insert. In alternative embodiments, initially the movable blade is inserted in the metal component and then the support insert is inserted between the cutter blade and the metal component. In alternative embodiments, the support insert and the cutter blade are jointly inserted in the metal component to accomplish the assembly procedure. In each of these cases, due to the shape of the metal component, a certain preloading is present so that the cutter blade is well-fitted in the guide slot.

In yet another exemplary embodiment of the method, the step of providing the metal component involves defining a mounting clearance between the first wall and the second wall of the metal component that is smaller than the mounting extension of the support insert and the movable blade in the contact region. The mounting clearance may involve an angular offset and/or a parallel offset between the first wall and the second wall.

In yet another exemplary embodiment of the method the movable blade is engaged by a driving connector that is inserted through a connector slot that is formed in the support insert. This may involve an attachment of the driving connector at a bottom side of the movable blade. Together, the driving connector and the movable blade may be moved with respect to the stationary blade in the lateral direction.

The method may further involve assembling lateral end caps to secure the assembly.

In yet another aspect of the present disclosure there is presented a hair cutting appliance arranged to be moved through hair to cut hair, the appliance comprising:

a housing comprising a handle section, a drive unit arranged in the housing, and a cutting head comprising a blade set in accordance with at least one embodiment as described herein.

Generally, the blade set may comprise a basically linear leading edge defined by a respective series of stationary blade teeth (and movable blade teeth). In accordance with this embodiment, a basically reciprocating and substantially linear relative movement between the movable blade and the stationary blade is present. However, this does not exclude embodiments, wherein an at least somewhat curved (oscillatory) movement path of the movable blade with respect to the stationary blade is present. This may be caused, for instance, by a respective guiding linkage for the movable blade.

Further, in addition to basically linear arrangements of blade sets, also curved or even circular arrangements of blade sets may be envisaged. Hence, accordingly, a somewhat curved or circular leading edge defined by a respective arrangement of stationary blade teeth (and movable blade teeth) may be provided. Therefore, whenever reference herein is made to a longitudinal direction, a lateral direction and/or a height direction, this shall not be interpreted in a limiting sense. A curved or circular blade set may be defined and described with reference to similar directions, but also with reference to polar directions and/or further appropriate directional information. Hence, Cartesian coordinate systems, but also polar coordinate systems and further appropriate coordinate systems may be used to describe linear and/or curved designs of blade sets.

In some embodiments, the blade set is provided with two opposite leading edges, i.e. two opposite series of stationary blade teeth and movable blade teeth. In this way, both a pulling and a pushing movement of the blade set may be used for the cutting operation. Further, in this way the hair cutting appliance can be deployed more flexibly which may facilitate styling operations and hair cutting operations in hard-to-reach areas.

Further preferred embodiments are defined in the dependent claims. It shall be understood that the claimed method has similar and/or identical preferred embodiments as the claimed device(s) and as defined in the dependent claims.

BRIEF DESCRIPTION OF THE DRAWINGS

These and other aspects of the invention will be apparent from and elucidated with reference to the embodiment described hereinafter. In the following drawings

DETAILED DESCRIPTION OF THE INVENTION

Figure 1:
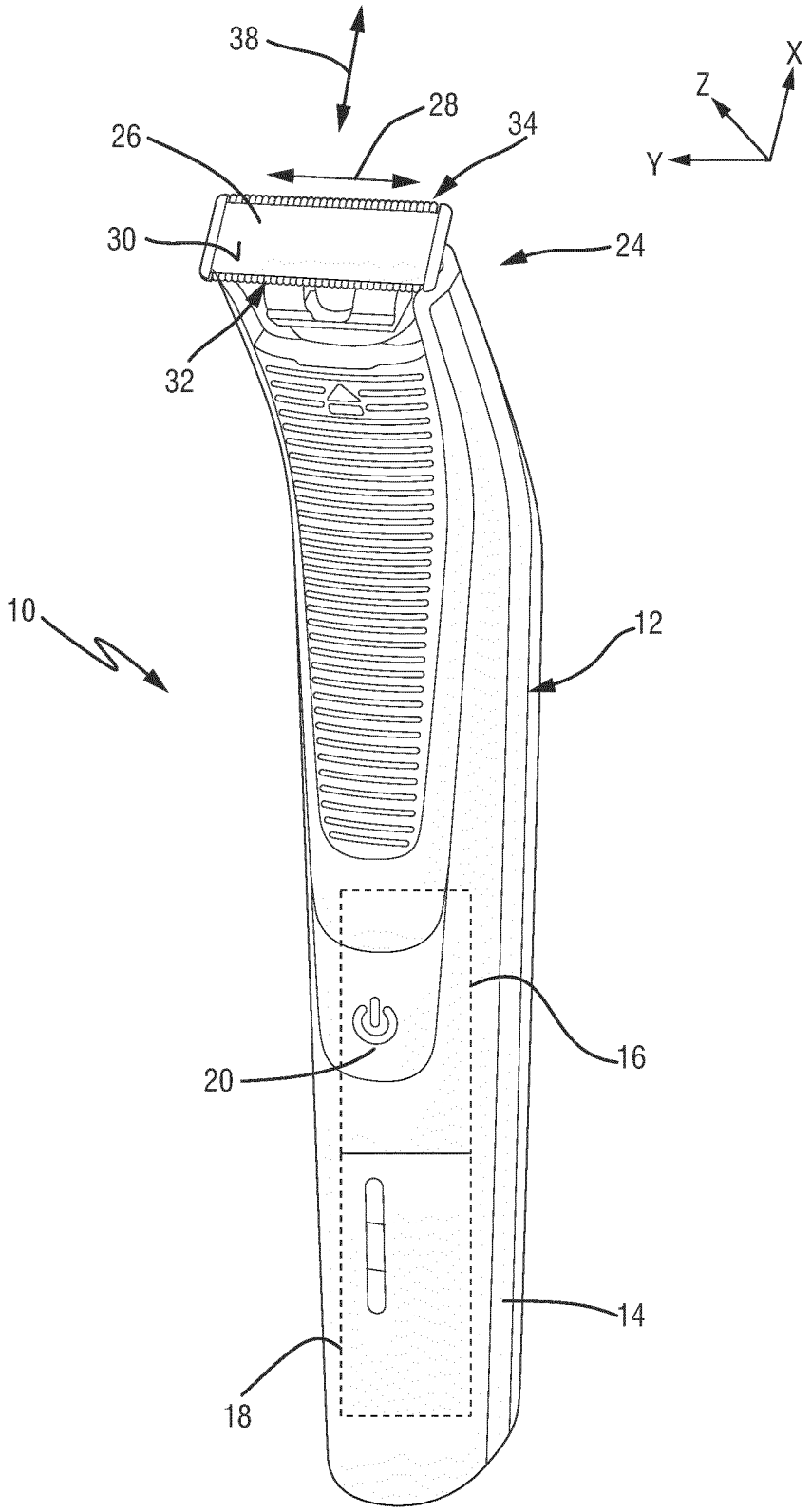
FIG. 1 shows a perspective frontal view of an exemplary embodiment of a hair cutting appliance.

FIG. 1 shows a perspective frontal view of a hair cutting appliance 10. The hair cutting appliance 10 is arranged as an appliance that is capable of both trimming and shaving.

The hair cutting appliance 10 comprises a housing 12 which is arranged in an elongated fashion. At the housing 12, a handle section 14 is defined. In the housing 12, a drive unit 16 is arranged. Further, a battery 18 may be arranged in the housing 12. In FIG. 1, the drive unit 16 and the battery 18 are represented by dashed blocks. At the housing 12, operator controls 20 such as on/off buttons and the like may be provided.

At a top end thereof, the hair cutting appliance 10 comprises a processing head 24 that is attached to the housing 12. The processing head 24 comprises a blade set 26. The blade set 26, particularly a movable blade thereof, may be actuated and driven by the drive unit 16 in a reciprocating fashion, refer also to the double arrow 28 in FIG. 1. As a result, respective teeth of the blades of the blade set 26 are moved with respect to one another, thereby effecting a cutting action. A top side or top surface of the blade set 26 is indicated by 30 in FIG. 1.

The blades of the blade set 26 may be arranged at a first leading edge 32 and, in at least some embodiments, at a second leading edge 34 that is opposite to the first leading edge 32. The first leading edge 32 may be also referred to as frontal leading edge. A second leading edge 34 may be also referred to as rear leading edge.

Further, a general advancing or moving direction of the hair cutting appliance 10 is indicated in FIG. 1 by a double arrow 38. As the blade set 26 of the exemplary embodiment of FIG. 1 is equipped with first and second leading edges 32, 34, a push and a pull movement may be used to cut hair.

In the following, exemplary embodiments of stationary blades and blade sets 26 will be elucidated and described in more detail. The blade sets 26 may be attached to the hair cutting appliance 10, or to a similar appliance. It goes without saying the single features disclosed in the context of a respective embodiment may be combined with any of the other embodiments, also in isolated fashion, thereby forming further embodiments that still fall under the scope of the present disclosure.

In some Figures shown herein, exemplary coordinate systems are shown for illustrative purposes. As used herein, an X-axis is assigned to a longitudinal direction. Further, a Y-axis is assigned to a lateral direction. Accordingly, a Z-axis is assigned to a vertical (height) direction. Respective associations of the axes/directions X, Y, Z with respective features and extensions of the blade set 26 can be derived from those Figures. It should be understood that the coordinate system X, Y, Z is primarily provided for illustrative purposes and not intended to limit the scope of the disclosure. This involves that the skilled person may readily convert and transform the coordinate system when being confronted with further embodiments, illustrations and deviating view orientations. Also a conversation of Cartesian coordinate systems into polar coordinate system may be envisaged, particularly in the context of a circular or curved blade set.

Figure 2:
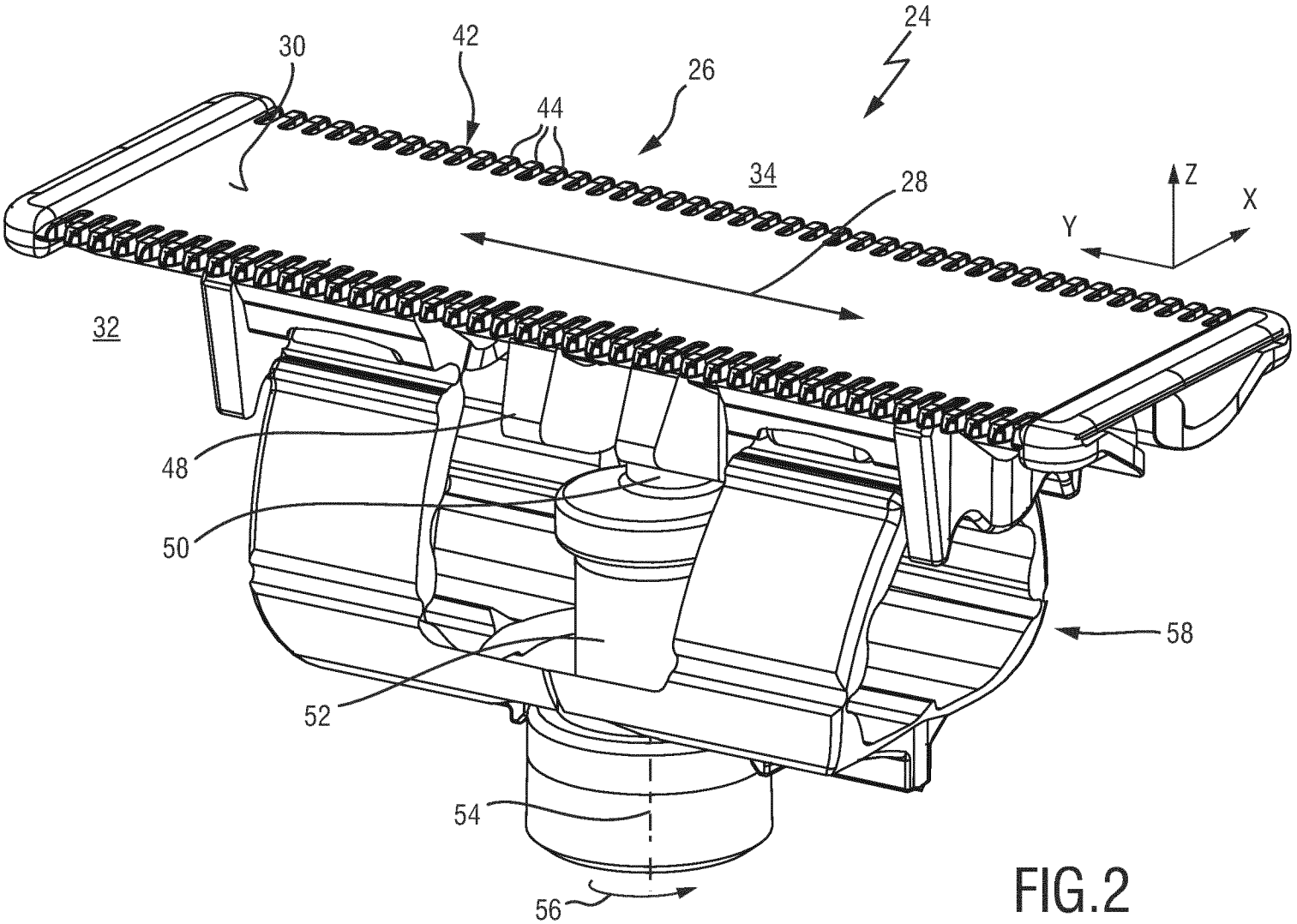
FIG. 2 shows a perspective top view of an exemplary embodiment of a blade set for a hair cutting appliance.

In FIG. 2, a perspective view of a blade set 26 for a processing head or cutting head 24 of a hair cutting appliance 10 is shown. As with the embodiment shown in FIG. 1, a cutting direction and/or a direction of a relative movement of blades of the blade set 26 is indicated by the double arrow 28. A top side of the blade set 26 that is facing the user when the hair cutting appliance 10 is operated is indicated by 30. In the exemplary embodiment shown in FIG. 2, the blade set 26 is provided with a first leading edge 32 and a second leading edge 34. In FIG. 2 a stationary blade 42 of the blade set 26 is shown. A movable blade (cutter blade) is covered by the stationary blade 42 in FIG. 2. Stationary blade teeth are indicated by 44.

The movable blade of the blade set 26 that is not visible in FIG. 2 is operated and actuated via a driving engagement element 48 that may also be referred to as driving bridge. At the driving engagement element 48, a driving or engagement slot is formed that is engaged by a driving pin 50 of a driving shaft 52. The driving shaft 52 is rotated about a driving axis 54, refer to a curved arrow 56. The driving pin 50 is off-centered with respect to the driving axis 54. Consequently, as the driving pin 50 is revolving, a reciprocating movement of the movable blade with respect to the stationary blade 42 is affected.

In FIG. 2, there is further indicated a pivot mechanism 58 which may be referred to as a contour following feature. The pivot mechanism 58 enables a certain pivot movement of the blade set 26 about the Y-axis.

With reference to FIGS. 3 to 11, exemplary embodiments of blade sets 26 that are operable in the hair cutting appliance 10 as shown in FIG. 1 and a processing head 24 as shown in FIG. 2 will be illustrated and described in more detail.

Figure 3:
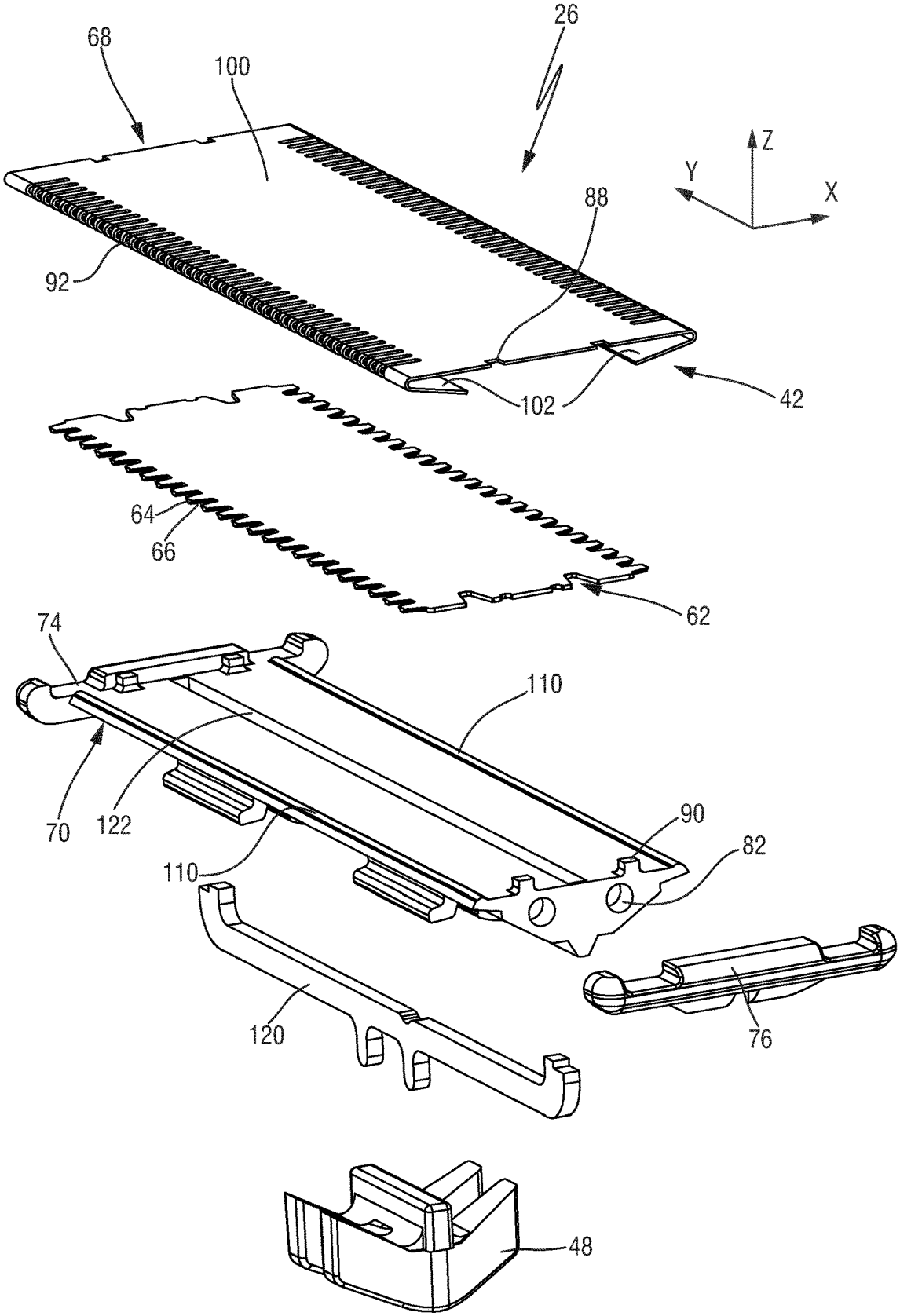
FIG. 3 shows an exploded perspective top view of an exemplary embodiment of a blade set for a hair cutting appliance.
Figure 4:
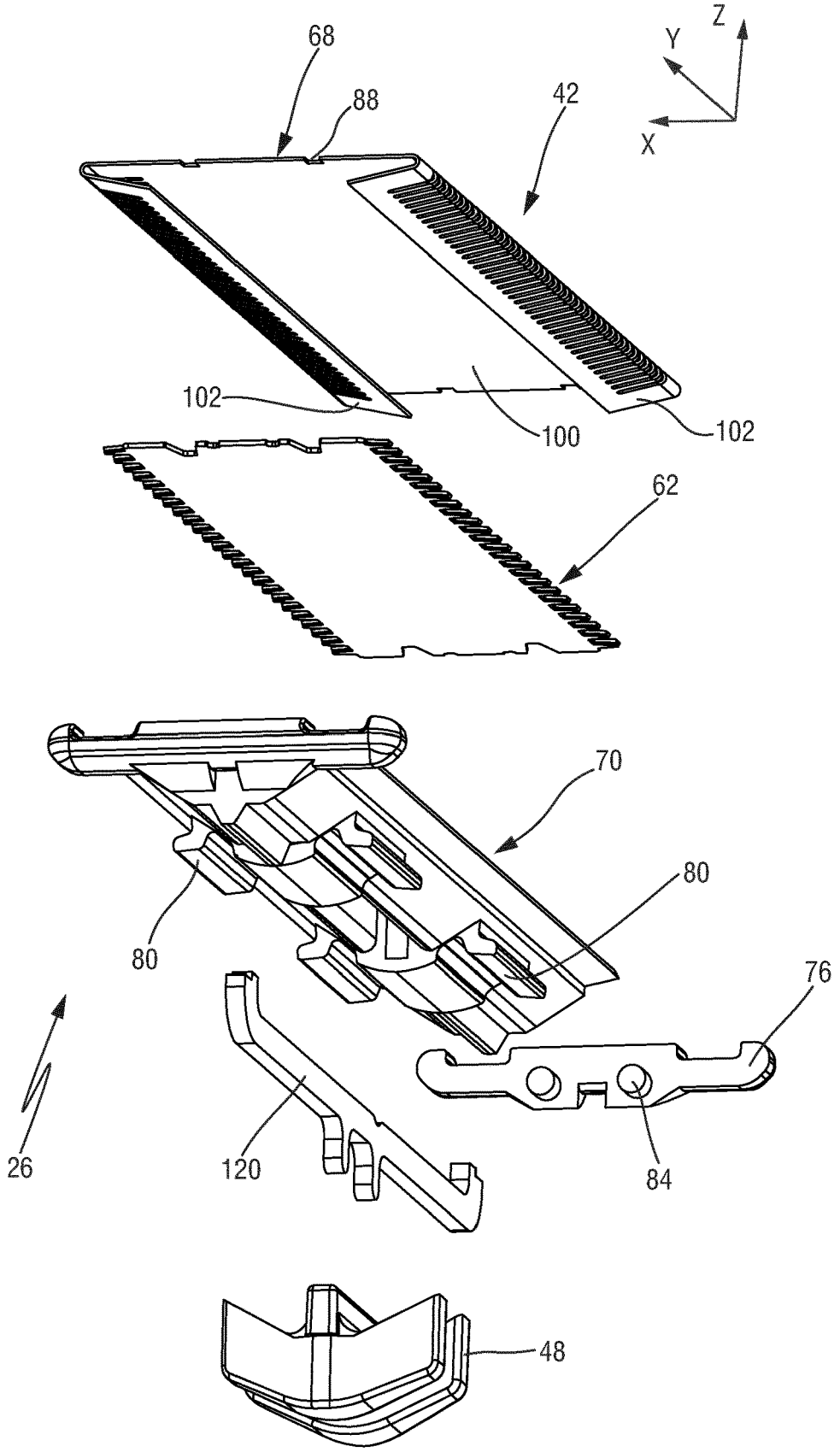
FIG. 4 shows an exploded perspective bottom view of the arrangement of FIG. 3.

FIG. 3 and FIG. 4 show perspective exploded views of an exemplary embodiment of a blade set 26 in accordance with the present disclosure. The blade set 26 comprises a movable blade 62 that is arranged in the stationary blade 42. The movable blade 62 is arranged in a guide slot 60 that is formed in the stationary blade 42, refer to FIG. 6 and FIG. 7.

Figure 5:
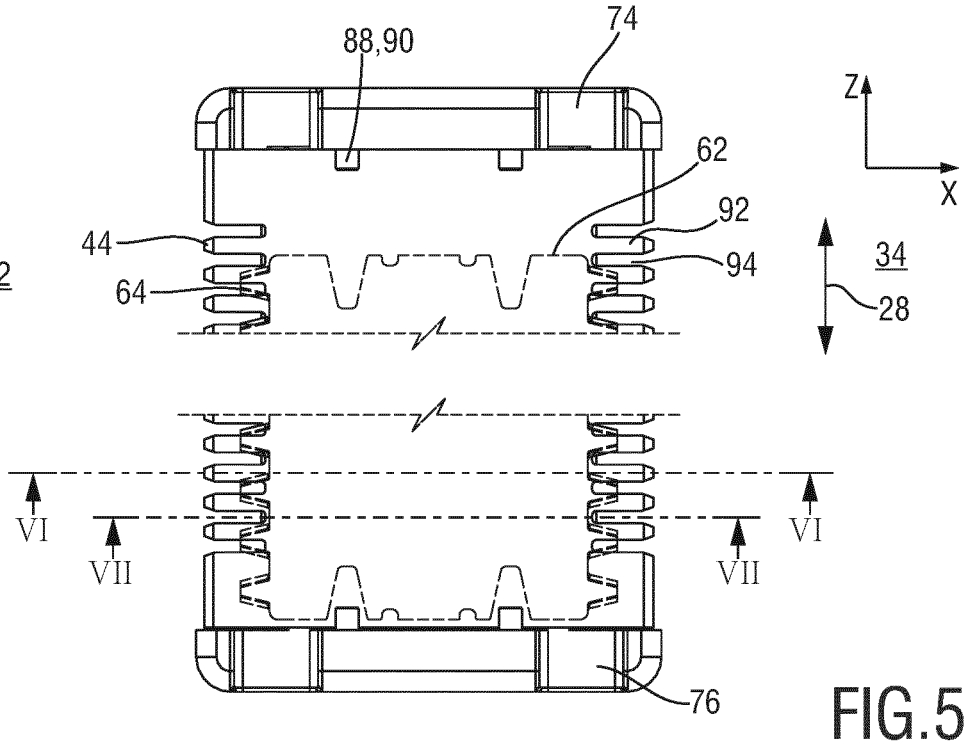
FIG. 5 shows a broken top view of the arrangement of FIG. 3.

In the guide slot 60, the movable blade 62 is reciprocatingly movable, refer to the double arrow 28 in FIG. 5. In an operating state, movable blade teeth 64 of the movable blade 62 may cooperate with stationary blade teeth 44 of the stationary blade 42 to cut hair. Tooth slots 66 are formed between neighboring teeth of the movable blade teeth 64.

In accordance with major aspects of the present disclosure, the stationary blade 42 is an assembly that includes a metal component 68 and a support insert 70. As shown in FIGS. 3 and 4, the stationary blade 42 is composed of at least two separate components that are mounted to one another.

In the assembled state as illustrated in FIG. 5, a first lateral end of the stationary blade 42 is formed by an end cap 74. A second, opposite lateral end of the stationary blade 42 is formed by an end cap 76. As shown in FIGS. 3 and 4, the end cap 74 is integrally formed with a main body of the support insert 70. By contrast, the end cap 76 is formed as a separate component that is arranged to be attached to the support insert 70 subsequent to intermediate assembly steps in which the support insert 70 is laterally inserted in the metal component 68. The insertion direction is parallel to the Y-axis.

Further, the intermediate assembly procedure involves a lateral insertion of the movable blade 62. The movable blade 62 is inserted in the guide slot 60 that is defined between the metal component 68 and the support insert 70, refer again to FIG. 7.

Thereafter, the end cap 76 may be fitted onto the support insert 70 to secure the assembly. Needless to say, alternative embodiments are conceivable that do not require end caps 74, 76.

In at least some embodiments, the support insert 70 is a molded part. By way of example, the support insert 70 is an injection-molded plastic part. Hence, further features and elements may be integrally formed with the support insert 70. By way of example, at a bottom side of the support insert 70 that is visible in FIG. 4, mounting features 80 are formed thereon. The mounting feature 80 may be arranged as mounting hooks that are arranged to engage corresponding locking features of the processing head 24, for instance locking features that are present at the contour following pivot mechanism 58 indicated in FIG. 2.

As can be further seen from FIG. 3 and FIG. 4, mounting features 82, 84 may be provided to attach the end cap 76 at the support insert 70. Mounting features 82 that are formed at a respective lateral end of the support insert 70 are arranged as recesses. Opposite mounting features 84 that are arranged at the end cap 76 are arranged as pins that match the mounting features 82.

Positive-locking features may be provided to define the assembly position and orientation of the metal component 68 and the support insert 70. By way of example, mounting features 88 that are arranged as notches are formed at lateral ends of the metal component 68. At the support insert, mounting features 90 that are arranged as protrusions that match the mounting features 88 are provided. Hence, due to the mounting features 88, 90 the lateral and the longitudinal position of the metal component 68 with respect to the support insert 70 may be accurately defined.

The stationary blade teeth 44 are formed by tooth portions 92 provided by the metal component 68. Between the tooth portions 92, tooth slots 94 are formed at the metal component 68, refer also to FIG. 5. Preferably, the tooth portions 92 are created by forming a series of tooth slots 94 in an initial planar state of the metal component 68. Single tooth slots 94 have a basically longitudinal orientation (X-direction). The series of tooth slots 94 has a lateral orientation (Y-direction).

It is noted, however, that in alternative embodiments, also the support insert 70 may be provided with tooth portions that are aligned with the tooth portions 92 of the metal component 68. As the support insert 70 is regularly formed from plastic material, any tooth portions thereof may support or strengthen the stationary blade teeth 44 in the assembled state, but do not necessarily play an active role in the hair cutting procedure.

Figure 7:
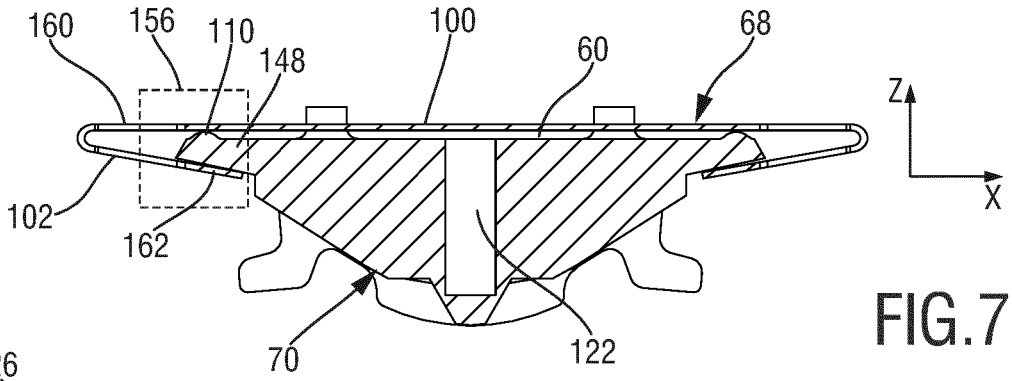
FIG. 7 shows a further view of the arrangement of FIG. 6, wherein an end cap and a driving connector have been omitted for illustrative purposes.
Figure 6:
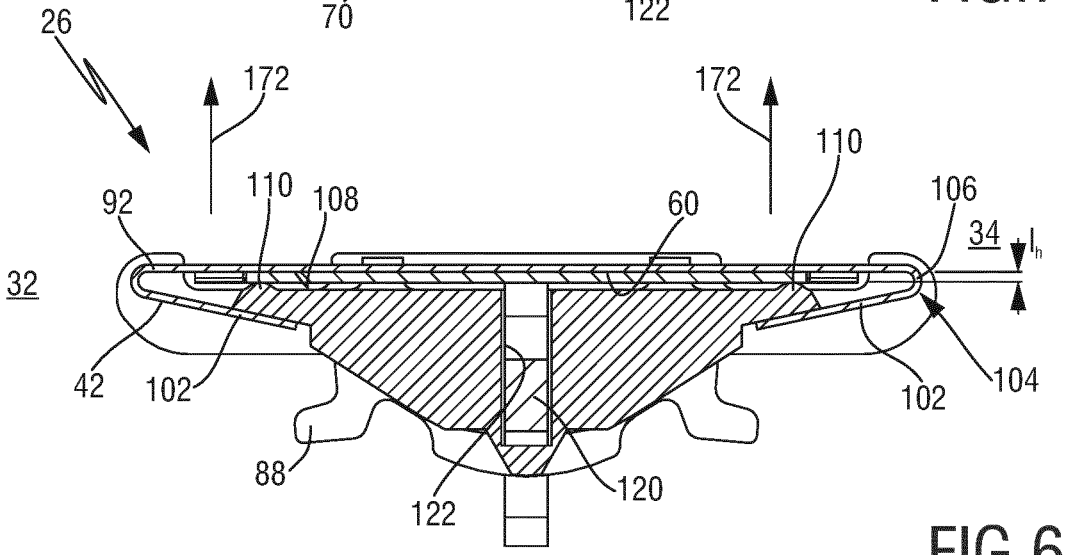
FIG. 6 shows a cross-sectional lateral view along the line VI-VI in FIG. 5.
Figure 8:
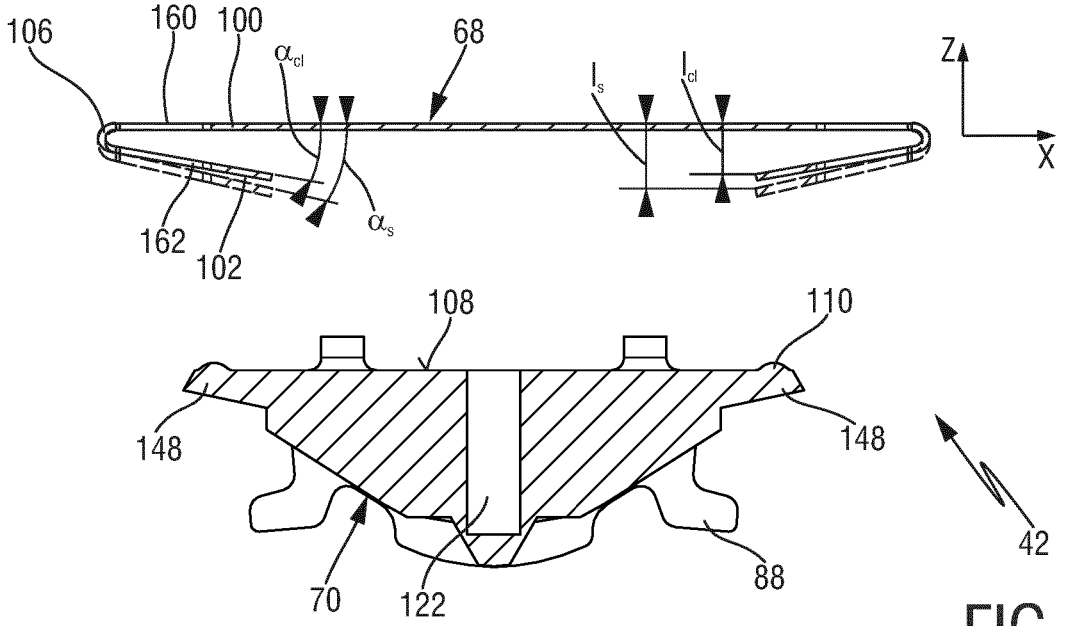
FIG. 8 shows a further lateral cross-sectional view in accordance with FIG. 6 and FIG. 7, wherein a metal component and a support insert that form a stationary blade are illustrated in FIG. 8 in a detached state.

The tooth portions 92 of the metal component 68 are jointly defined by a first wall 100 and a second wall 102 thereof. In this context, reference is made to FIG. 6 to FIG. 8. FIGS. 6 to 8 illustrate several assembly stages of the blade set 26, wherein respectively a cross-sectional lateral view is illustrated, a position of which is indicated in FIG. 5 by the lines VI-VI for FIG. 6 and VII-VII for FIG. 7.

At the metal component 68, basically two opposite second wall portions are provided that are associated with the first leading edge 32 and the second leading edge 34.

As discussed herein, the metal component 68 is obtained from sheet metal material through bending or folding. Hence, based on a single planar sheet metal blank, U-shaped or V-shaped tooth portions 92 may be obtained between which respective tooth slots 94 are formed. By bending or folding the metal component 68, the first leading edge 32 and the second leading edge 34 of the stationary blade 42 are defined.

At the first and second leading edges 32, 34, a respective folding/bending edge 104 is provided at a transition between the first wall 100 and the second wall 102. At the folding/bending edge 104, tips 106 of the stationary blade teeth 44 are formed (FIG. 6).

In the assembled state illustrated in FIG. 5 and FIG. 6, the movable blade 62 is movably retained in the guide slot 60, refer again to FIG. 7. In FIG. 5 the movable blade 62 is covered by the first wall 100 of the metal component 68 and therefore shown in a hidden edge representation by dashed lines.

As can be best seen in FIG. 6, contact ridges 110 are provided at an inner surface 108 of the support insert 70 in the guide slot 60. Hence, a limited contact zone between the bottom side of the movable blade 62 and the support insert 70 is provided in this exemplary embodiment.

Again, reference is made to FIG. 3 and FIG. 4. As shown therein, a driving connector 120 is provided that is arranged in a driving slot 122 formed in the support insert 70. As shown in FIG. 6, the movable blade 62 is attached to the driving connector 120, preferably fixedly attached. As the driving connector 120 is arranged in the driving slot 122, the longitudinal position (X-direction) of the movable blade 62 in the guide slot 60 is accurately defined. As the movable blade 62 is guided by the driving connector 120, there is no need of further guiding elements in the guide slot 60 to define the longitudinal position thereof.

A main aspect of the present disclosure is that the metal component 68 is deliberately deformed prior to the assembly with the support insert 70 (and/or with the movable blade 62) to be at least slightly smaller in height (Z-direction) than in the finally assembled state of the blade set 26. In this context, for illustrative purposes, reference is made to FIG. 6, FIG. 7 and FIG. 8. In FIG. 8, a detached non-assembled state of the metal component 68 and the support insert 70 is shown. In FIG. 7, an intermediate assembly state of the stationary blade 42 is shown. In FIG. 6, a final assembly state of the blade set 26 involving the stationary blade 42 and the movable blade 62 is shown.

As will be discussed in more detail further below, FIG. 8 illustrates an intermediate state of the metal component 68 wherein for illustrative purposes a final state resulting from the assembly procedure of the blade set 26 is indicated by dashed lines. In the intermediate state, the first wall 100 and the second wall 102 are closer to one another than in the final assembly state, refer also to FIG. 6.

In a contact region 156, a contact between the second wall 102 and a connector arm 148 of the support insert 70 is provided. In the region where the toothed portions 92 are formed, a first leg 160 is formed at the first wall 100, and a second leg 162 is formed at the second wall 102. The first leg 160 and the second leg 162 are connected to form the double-walled stationary blade teeth 44 having tips 106.

A mounting clearance $l_{cl}$, $\alpha_{cl}$ between the first leg 160 and the second leg 162 that is provided in the intermediate state as shown in FIG. 8 is therefore smaller than a resulting spacing offset $l_s$, $\alpha_s$ provided in the guide slot 60 after the assembly of the movable blade 62 in the stationary blade 42. As a result, the movable blade 62 is at least slightly preloaded in the vertical direction (Z-direction). This may have the effect that only little or even no vertical play is provided in the assembled state. This increases the cutting performance as involved cutting edges of the stationary blade teeth 44 and the movable blade teeth 64 may cooperate efficiently to cut hair.

As a result of the deformation of the metal component 68, an intermediate spacing offset that is present in the guide slot 60 in an intermediate assembly state (FIG. 7) between the first wall 100 of the metal component and the support insert 70 is at least slightly smaller than the spacing offset $l_s$, $\alpha_s$ that is basically necessary to accommodate the movable blade 62 in the guide slot 60 in the finally assembled state as shown in FIG. 6.

In other words, when the movable blade 62 is inserted in the guide slot 60, the metal component 68 is at least slightly deformed, wherein the second legs 162 are brought further away from the opposite first legs 160. Hence, the first wall 100 is at least slightly lifted from the support insert 70. As a further result, the contact force between the metal component 68 and the support insert 70 is further increased.

As shown in the exemplary embodiment illustrated in FIGS. 3 to 5, mounting features 88, 90 provide for a positive-fit connection between the metal component 68 and the support insert 70. Therefore, the metal component 68 is not displaced relative to the support insert 70 in the longitudinal direction (X-direction) and/or the direction (Y-direction). Hence, a certain insertion force may be applied onto the movable blade 62 to deform the metal component 68 as the movable blade 62 is inserted in the guide slot 60.

As illustrated in FIG. 8, the mounting clearance $l_{cl}$, $\alpha_{cl}$ between the first leg 160 and the second leg 162 may be defined by any of a vertical distance and/or an angular offset there between.

In FIG. 6, arrows 172 indicate a lifting action that is necessary to make the guide slot 60 large enough to accommodate the movable blade 62 therein.

An important aspect of the present disclosure is that a resulting assembly clearance $l_{cl}$ in the finally assembled state in the guide slot 60 is basically equal to the height of the movable blade 62 in the relevant contact regions, e.g. in the vicinity of the contact ridges 110 and the opposite portion of the first wall 100 and/or the first leg 160. Further, the assembly clearance (height) $l_h$ is not defined by a portion of the support insert 70 that would define the clearance also in the finally assembled state. Hence, there is no direct connection necessary between the support insert 70 and the inner side of the first wall 100 that faces the guide slot 60, at least in the finally assembled state when the movable blade 62 is inserted.

In connection with the above-described FIGS. 1 to 8, several aspects and embodiments of the present disclosure have been discussed with reference to relatively detailed embodiments. Based thereon, reference is made to FIG. 9, FIG. 10 and to FIG. 11, schematically illustrating alternative embodiments that may however utilize at least some of the above-discussed features, components and sub-assemblies. Therefore, in the following primarily deviations are emphasized and explicitly discussed. Apart from that, the arrangements of any of FIGS. 9, 10 and 11 may be arranged in accordance with the above-discussed embodiments, and vice versa.

Figure 9:
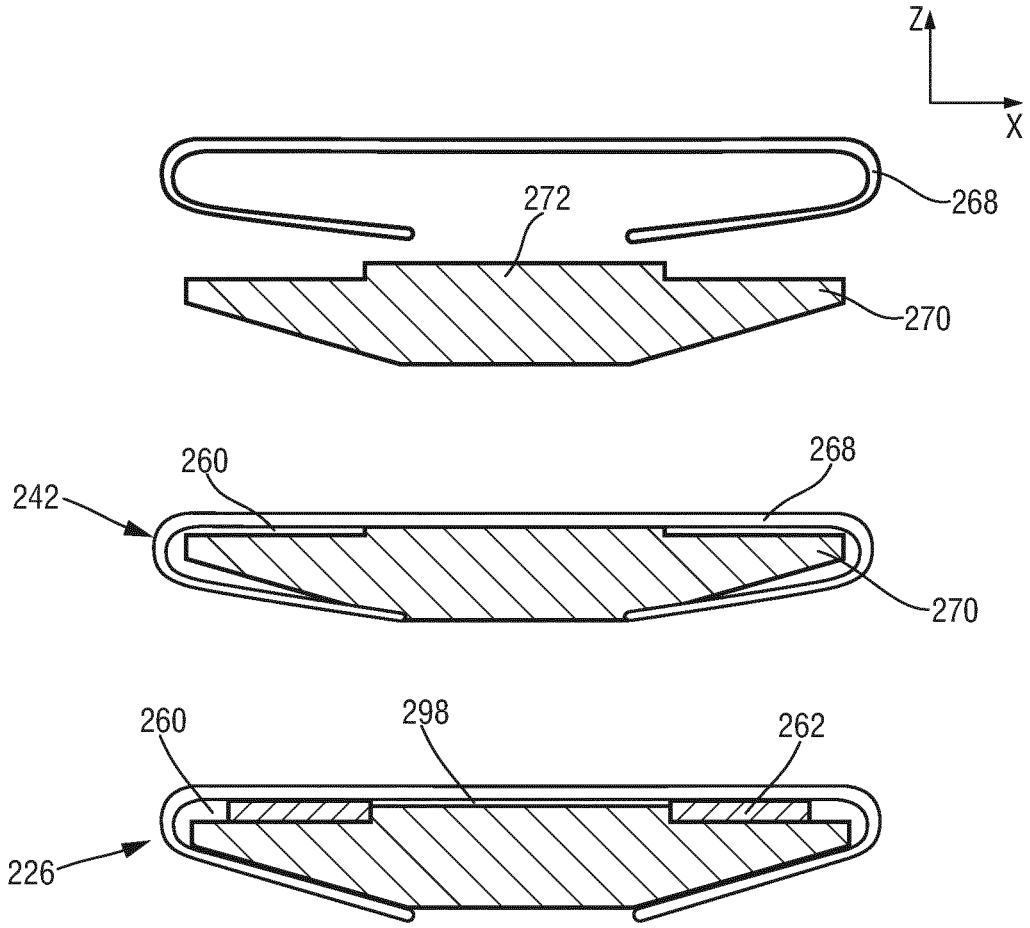
FIG. 9 shows in a schematic simplified cross-sectional view a further embodiment of a blade set in accordance with the present disclosure.

FIG. 9 schematically illustrates a lateral cross-sectional view of a blade set 226 in different assembly states. In a first assembly state, a metal component 268 and a support insert 270 are shown in a detached condition. In a second state, an intermediate assembly of the metal component 268 and the support insert 270 is shown that form a stationary blade 242. In a third state, a final assembly state of the blade set 226 is illustrated. As discussed herein before, in the final assembly state, a movable blade 262 that is received in a guide slot 260 at the stationary blade 242 defines the height of the guide slot 260.

A bending procedure is applied to the metal component 268 prior to the assembly with the support insert 270. In the resulting intermediate assembly state, due to the applied deformation, the guide slot 260 is actually smaller than required in the final assembly state. Hence, as the movable plate 262 is inserted, a third preloading and deformation is induced.

In the embodiment as shown in FIG. 9, a central guide protrusion 272 is formed at the support insert 270 that engages a corresponding guide recess 298 at the movable blade 262.

Figure 10:
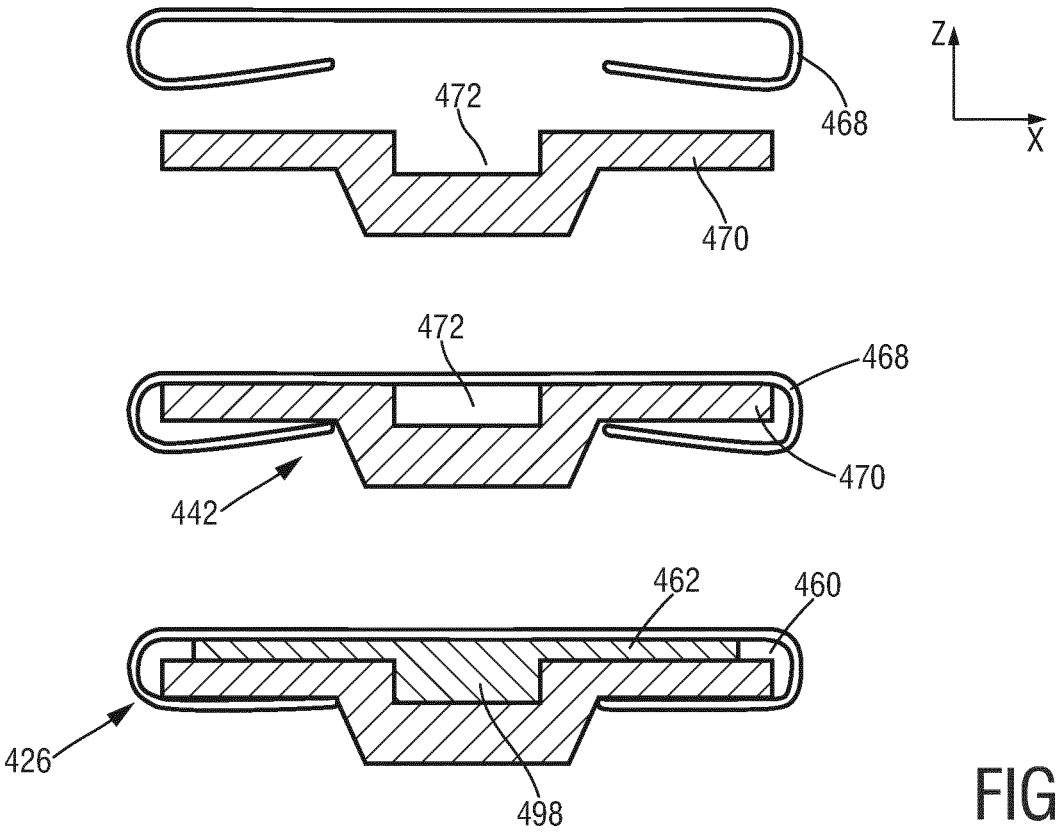
FIG. 10 shows in a schematic simplified cross-sectional view a further embodiment of a blade set in accordance with the present disclosure.
Figure 11:
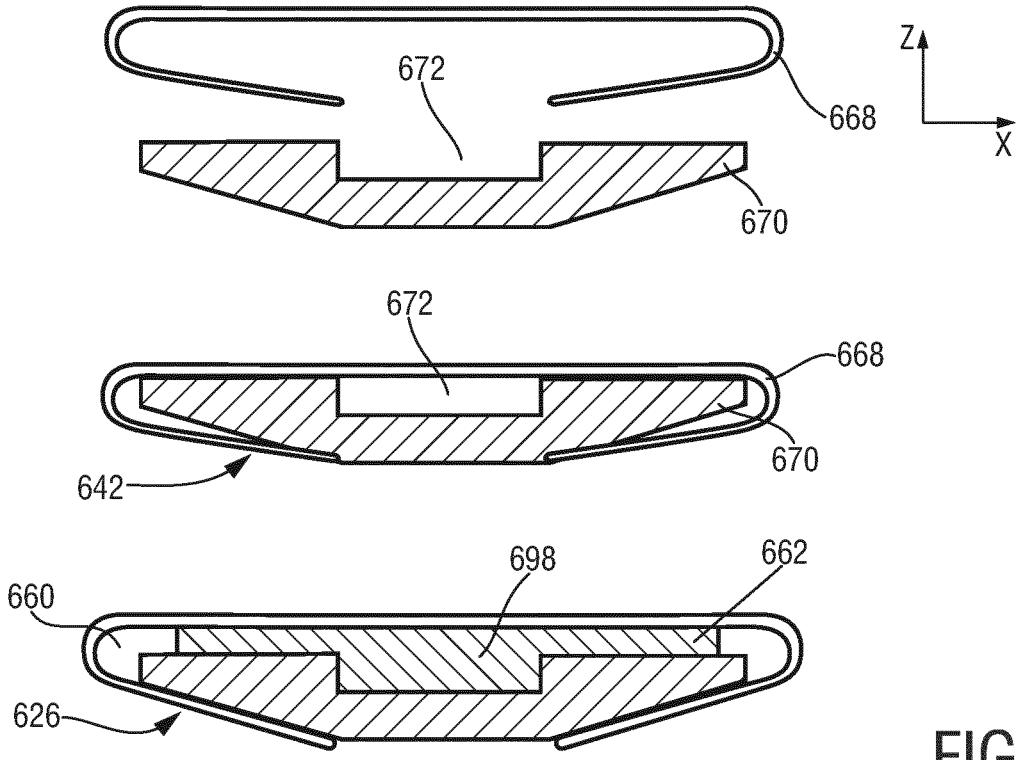
FIG. 11 shows in a schematic simplified cross-sectional view a further embodiment of a blade set in accordance with the present disclosure.

FIG. 10 schematically illustrates a lateral cross-sectional view of a blade set 426 in different assembly states. In a first assembly state, a metal component 468 and a support insert 470 are shown in a detached condition. In a second state, an intermediate assembly of the metal component 468 and the support insert 470 is shown that form a stationary blade 442. In a third state, a final assembly state of the blade set 426 is illustrated. As discussed herein before, in the final assembly state, a movable blade 462 that is received in a guide slot 460 at the stationary blade 442 defines the height of the guide slot 460.

A bending procedure is applied to the metal component 468 prior to the assembly with the support insert 470. In the resulting intermediate assembly state, due to the applied deformation, the guide slot 460 is actually smaller than required in the final assembly state. Hence, as the movable blade 462 is inserted, a third preloading and deformation is induced.

In the embodiment as shown in FIG. 10, a central guide recess 472 is formed at the support insert 470 that engages a corresponding guide protrusion 498 at the movable blade 462.

FIG. 11 schematically illustrates a lateral cross-sectional view of a blade set 626 in different assembly states. In a first assembly state, a metal component 668 and a support insert 670 are shown in a detached condition. In a second state, an intermediate assembly of the metal component 668 and the support insert 670 is shown that form a stationary blade 662. In a third state, a final assembly state of the blade set 626 is illustrated. As discussed herein before, in the final assembly state, a stationary blade 662 that is received in a guide slot 660 at the stationary blade 642 defines the height of the guide slot 660.

A bending procedure is applied to the metal component 668 prior to the assembly with the support insert 670. In the resulting intermediate assembly state, due to the applied deformation, the guide slot 660 is actually smaller than required in the final assembly state. Hence, as the stationary blade 662 is inserted, a third preloading and deformation is induced.

In the embodiment as shown in FIG. 11, a central guide recess 672 is formed at the support insert 670 that engages a corresponding guide protrusion 698 at the stationary blade 662.

Figure 12:
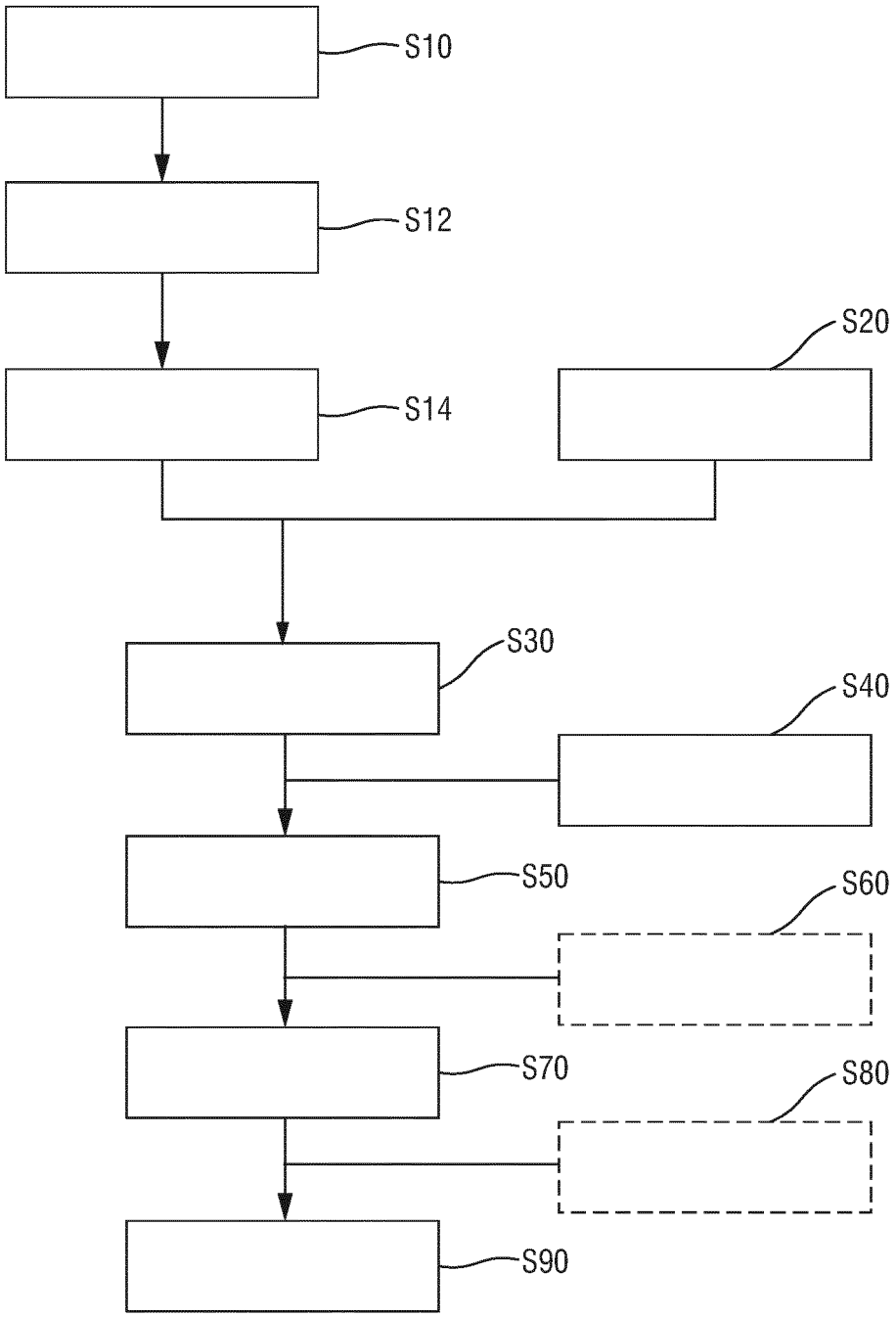
FIG. 12 shows a block diagram illustrating an exemplary embodiment of a method of manufacturing a blade set for a hair cutting appliance in accordance with the present disclosure.

Further reference is made to FIG. 12, schematically illustrating an exemplary embodiment of a method of manufacturing a blade set for a hair cutting appliance. The method involves the provision of a metal component, and a support insert that jointly form a stationary blade in which a movable blade is accommodated.

In a first step S10, a sheet metal blank is provided based on which the metal component is formed. In a following step S12, a series of tooth slots is processed in the sheet metal blank, preferably in an unfolded state. Hence, relatively simple manufacturing methods may be used. In a further step S14, the originally planar sheet metal blank is transformed. This may involve bending or folding the sheet metal material around a folding edge that is parallel to and crosses the series of tooth slots. Hence, a first wall and a second wall are formed that are connected to define a series of stationary blade teeth.

In a further step S20, a support insert is provided that is arranged to be inserted in the metal component processed in steps S10 to S14. The support insert may be obtained through molding, particular through injection-molding. Hence, the support insert may be made from plastic material, for instance. At the support insert, further features may be integrally formed, for instance mounting features, lateral end pieces, etc.

To assemble the blade set, in a first assembly step S30, the support insert and the metal component are assembled. This may involve an insertion of the support insert in the metal component between the first wall and the second wall. The first wall and the second wall of the metal component embrace or cover the support insert, at least partially. Both the metal component and the support insert form the stationary blade.

Preferably, the metal component and the support insert are force-fitted or interference-fitted. Hence, a certain preloading or pretensioning is induced in the metal component that generates a retaining force. As a result from the pre-assembly of the stationary blade, the metal component is at least slightly biased, due to the interface fit. This may involve that in the intermediate assembly state a guide slot that is jointly defined by the metal component and the support insert for the movable blade is smaller than actually required in the final assembly state. A certain corrective force is required to constitute the desired final dimension of the guide slot that is crucial for the operating performance of the appliance.

Further, in a step S40, a movable blade for the blade set is provided. Generally, the movable blade is adapted to be accommodated in the guide slot that is jointly defined by the metal component and the support insert.

In a step S50, the movable blade is inserted in the guide slot of the stationary blade. In the resulting assembled blade set, the movable blade is movably accommodated and at least slightly preloaded in a guide slot formed between the metal component and the support insert. The movable blade at least slightly lifts the first wall from the support insert, at least in a central region.

As indicated by dashed blocks, further optional steps S60 and S70 may follow. The optional step S60 involves the provision of an end cap for the stationary blade. The end cap may be an injection-molded plastic part.

In the step S70, the end cap is mounted to the support insert, to secure the assembly of the metal component and the support insert, and to retain the movable blade between respective lateral ends of the stationary blade.

In alternative embodiments, the mounted state of the metal component and the support insert and the defined movable arrangement of the movable blade in the guide slot is otherwise secured.

Optionally, steps S80 and S90 are provided. The step S80 involves the provision of a driving connector that is arranged to form part of or to be engaged by a drive train of the hair cutting appliance. The driving connector transmits the reciprocating driving movement to the movable blade. In a resulting assembly step S90, the driving connector is inserted through a driving slot that is formed in the support insert. Preferably, the driving connector is introduced at the bottom side of the support insert since the movable blade is already arranged in the guide slot in this state. The step S90 may also involve an attachment, preferably a fixed attachment, of the driving connector at the movable blade. A further result from this mounting procedure may involve the provision of a guide for the lateral movement of the movable blade. This may be achieved when the driving connector is tightly but movably arranged in the driving slot so that the position of the driving connector and thus the position of the movable blade in the longitudinal direction is accurately defined.

It is to be noted that the above steps do not necessarily define a fixed assembly sequence. However, in some exemplary embodiments, the assembly sequence (basically or even exactly) corresponds to the sequence of the above steps. In alternative embodiments, the movable blade may be inserted in the metal component prior to the insertion of the support insert. In alternative embodiments, the movable blade and he support insert may be jointly inserted in the metal component.

While the invention has been illustrated and described in detail in the drawings and foregoing description, such illustration and description are to be considered illustrative or exemplary and not restrictive, the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A blade set for a hair cutting appliance arranged to be moved through hair in a moving direction to cut hair, the blade set comprising:

a stationary blade comprising a support insert and a metal component, wherein: the metal component and the support insert are force-fitted to one another; the metal component is at least sectionally deformed to define at least one toothed leading edge having double-walled stationary blade teeth, the double-wall being defined by a first wall and a second wall; and the a first wall is arranged to face a skin of a user in operation and the second wall faces away from the first wall; and a movable blade comprising a plurality of movable blade teeth, wherein: a guide slot for the movable blade is defined between facing inner surfaces of the first wall, the second wall, and the support insert; the movable blade is movably arranged between the metal component and the support insert in the guide slot to define a mounted state where the movable blade is reloaded; a first side of the moveable blade is arranged to contact the inner surface of the first wall and a second side of the moveable blade is arranged to contact the inner surface of the support insert; and the movable blade is secured in the guide slot by at least one lateral end cap that blocks a lateral end of the guide slot.

2. The blade set as claimed in claim 1, wherein in the guide slot a vertical guide clearance for the movable blade is defined between the first wall of the metal component and a central portion of the support insert.

3. The blade set as claimed in claim 1, wherein the metal component is held in place by the support insert, and wherein the facing inner surfaces of the first wall, the second wall, and the support insert are spaced away from one another.

4. The blade set as claimed in claim 1, wherein the double-walled stationary blade teeth are, when viewed in a cross-sectional plane perpendicular to a longitudinal direction defined by the metal component, substantially U-shaped or V-shaped, and comprise a first leg formed by the first wall and a second leg formed by the second wall, and wherein the first leg and the second leg merge into one another to form a tip of the double-walled stationary blade teeth.

5. The blade set as claimed in claim 1, wherein the metal component is a sheet metal component, and wherein the support insert is a separately formed injection molded plastic part.

6. The blade set as claimed in claim 1, wherein a lateral guide for the movable blade is provided by a driving connector attached to the movable blade, and wherein the driving connector is slidably received in a connector slot formed in the support insert.

7. The blade set as claimed in claim 1, wherein the at least one lateral cap comprises first lateral cap attached to the support insert and a second lateral cap attached to the support insert opposite the first lateral cap, and wherein a second lateral cap is a separately formed part that is attached to the support insert opposite to the first lateral cap.

* * * * *